United States Patent [19]

Prill

[11] 4,007,697

[45] Feb. 15, 1977

[54] STOKER ACTUATED COAL BURNING APPARATUS

[75] Inventor: LeRoy W. Prill, Ranchester, Wyo.

[73] Assignee: Prill Manufacturing Company, Sheridan, Wyo.

[22] Filed: Oct. 2, 1975

[21] Appl. No.: 619,076

[52] U.S. Cl. ..... 110/45; 110/44 B

[51] Int. Cl.[2] ..... F23K 3/18

[58] Field of Search ..... 110/45, 46, 44 R, 44 B, 110/36

[56] References Cited

UNITED STATES PATENTS

| | | | |
|---|---|---|---|
| 2,033,919 | 3/1936 | Burton | 110/45 |
| 2,396,888 | 3/1946 | Scholl | 110/45 |
| 2,405,982 | 4/1946 | Schweickart et al. | 110/45 |
| 2,455,817 | 12/1948 | Sherman | 110/45 |
| 3,289,620 | 12/1966 | Heilala | 110/45 |

*Primary Examiner*—Kenneth W. Sprague

[57] ABSTRACT

The apparatus includes a feed box with a horizontal intake port for connection to a stoker feed and a vertical discharge port for transmitting coal to the burning zone, with a curved passage between the ports. An annular burner body has a central annular vertical delivery ring coaxial with the discharge port, a downwardly and outwardly sloped annular burner grid, and a marginal depending stabilizing flange. The ring and the flange rest on the top plate of the feed box for support and are keyed against rotation. An ash ring has an inner margin resting on the outer margin of the grid for support and rotation, and its upper surface slopes upward and outward to define with the grid surface an annular recess for retaining burning coal. A plurality of ribs on the ash ring and at least one breaker tooth on the grid cooperate to break down clinkers as the ring rotates, driven by a sprocket on the conveyor shaft. An air supply conduit surrounds the fuel conveyor tube and feeds passages at each side of the discharge port to supply combustion air.

17 Claims, 7 Drawing Figures

STOKER ACTUATED COAL BURNING APPARATUS

BACKGROUND OF THE INVENTION

This invention lies in the field of apparatus for burning coal and is directed to such apparatus which is fed with fuel by a stoker conveyor and with air for combustion by a blower. It is more particularly directed to such an apparatus in which coal is fed upward and then radially outward over a burner grid and then outward over an ash ring. Although not so limited it is especially suitable for use in domestic type heating assemblies.

Stoker assemblies of this general type have been in use for many years and have taken many forms. Some units convey coal into a burner box with a generally flat grate at the bottom through which ashes fall naturally or by agitation. The green coal is deposited on top of the burning coal and the size of the fire is difficult to control within desired limits. The blanket of green coal confines the burning bed beneath it and many rather sizable clinkers are produced which are difficult to dislodge and remove.

In another type the burner box bottom is formed with a flat horizontal grate in one section and an ash tray in another. The coal is fed in at the margin of the grate and the entire mass is pushed across the box to discharge ashes at the far edge of the tray. Clinkers are formed as in the other type but they are dicharged without difficulty.

Both of the units mentioned operate reasonably well but they tend to produce rather incomplete combustion which is wasteful of energy and causes pollution. The larger clinkers particularly contain a substantial amount of unburned fuel.

The more complex forms of stokers frequently are constructed with a fire pot having a lower retort and an upper tuyere wall or burner head, with the stoker feeding coal into an opening in the bottom of the retort. The coal moves upward and burns primarily in the burner head, with the ash falling over the edge onto a grate or into an ash pit. Combustion is more complete but clinkers still form and fall into the ash pit with incomplete combustion. The burner head may be stationary or rotatable but the result is approximately the same. In some units a bracket is provided to engage large clinker formations extending beyond the burner head and separate them from the main body but they do not break down the clinkers themselves. This general type of apparatus, as commercially marketed, contains a very large number of parts and is unduly complicated, resulting in high construction and maintenance costs.

SUMMARY OF THE INVENTION

The apparatus of the present invention overcomes the disadvantages mentioned above and provides a simple and reliable stoker assembly with a minimum number of parts which are easy to assemble and need practically no maintenance. In operation it acts to break down clinkers automatically and accomplish substantially complete combustion, thus attaining maximum energy recovery from the fuel and minimizing pollution, and producing a minimum quantity of ashes to be disposed of.

Generally stated, the apparatus includes three major components in addition to the basic stoker mechanism. The first component is a feed box which may be mounted in any suitable manner on a stationary supporting means in a heating unit. In the presently preferred form the feed box has a generally horizontally directed intake port for connection to the end of a stoker conveyor tube, a vertically directed discharge port for transmission of coal to a burning zone, and a curved fuel passage extending between the two ports. The upper end of the feed box is formed as a horizontal supporting plate surrounding the discharge port and has an upstanding annular guide ridge for for locating the burner body, with at least one interruption in its annular continuity to prevent relative rotation of the burner body.

The burner body itself comprises a central annular vertically directed delivery ring, an annular burner grid extending radially outward from the delivery ring, and an annular stabilizing flange depending from the outer perimeter of the grid, with its lower edge coplanar with the lower edge of the delivery ring. The burner body is placed directly on the supporting plate of the feed box with the delivery ring resting on the plate in coaxial relation with the discharge port and with the stabilizing flange resting on the plate and closely surrounding the guide ridge to position the burner body. An abutment on the stabilizing flange engages the interruption in the guide ridge to prevent rotation of the burner body.

An annular ash ring has an inner marginal portion directly overlying the outer marginal portion of the burner grid and an outer marginal portion extending outward beyond the grid. The upper surface of the grid slopes outward and downward and the upper surface of the ash ring slopes outward and upward, the two surfaces defining between them an annular recess for retaining burning coal. The outer marginal portion of the grid lies in a horizontal plane and its juncture with the sloping inner portion defines a guide to maintain the ash ring coaxial with the grid. The inner marginal portion of the ash ring lies in direct contact with the flat portion of the grid, preventing ashes or burning fuel from falling between them. The flat portion also serves as a bearing to support the ring for rotation. The outer margin of the ring has a depending flange provided with a plurality of depending teeth engageable by a drive sprocket to cause rotation of the ring.

A plurality of peripherally spaced upstanding ribs are provided on the upper surface of the ash ring and extend between the inner and outer margins and down the inner marginal edge to intercept clinkers and break them down. At least one breaker tooth is provided on the upper surface of the burner grid with its radially outward edge adjacent to the path of movement of the ribs and coacts with them in breaking down the clinkers.

A conveyor tube is connected to the intake port of the feed box and the screw conveyor shaft extends into and through the fuel passage and out the far side of the feed box. A drive sprocket is mounted on its free end in position to engage the teeth on the ash ring and cause its rotation.

An air supply conduit surrounds the conveyor tube and is connected to the intake portion of the feed box. An air passage is formed in the feed box at each side of the fuel passage with an intake end communicating with the air supply conduit and a discharge end terminating in the supporting plate in the area beneath the burner grid and between the delivery ring and the stabilizing flange to supply combustion air to the grid.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENTS

Figure 1:
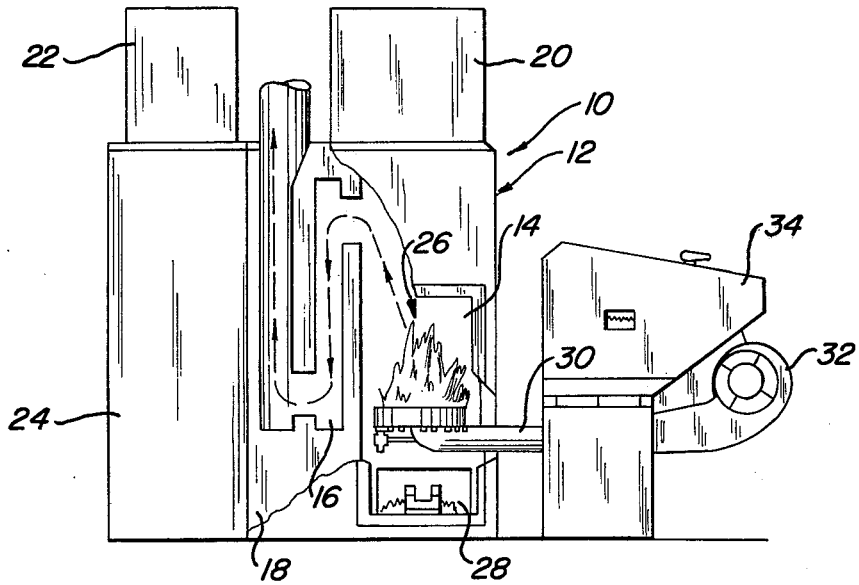
FIG. 1 is a diagrammatic side elevational view, with parts broken away, of a stoker fed heating assembly incorporating the features of the invention.

The features of the invention are used in association with the general assemblage illustrated in FIG. 1, in which the total heating system 10 includes an enclosure 12 containing a fire box 14, a double reverse heat exchanging passage 16 for the flow of heated products of combustion to the exterior atmosphere, a heat exchange chamber 18 surrounding the passage and leading to the heated air plenum 20 for distribution to desired locations, a return air plenum 22, and a blower chamber 24 for delivering return air to the heat exchange chamber. The coal burning apparatus 26 is supported in the generally central portion of the fire box and an ash container 28 is removably contained in the bottom portion of the fire box to receive and store ashes discharged by apparatus 26, the container being removed from time to time for cleaning. An air supply conduit 30 extends from blower 32 to the lower portion of apparatus 26, and a fuel conveyor 36, FIG. 2, is located within the air supply conduit and extends from the coal storage hopper 34 to the lower portion of apparatus 26.

Figure 2:
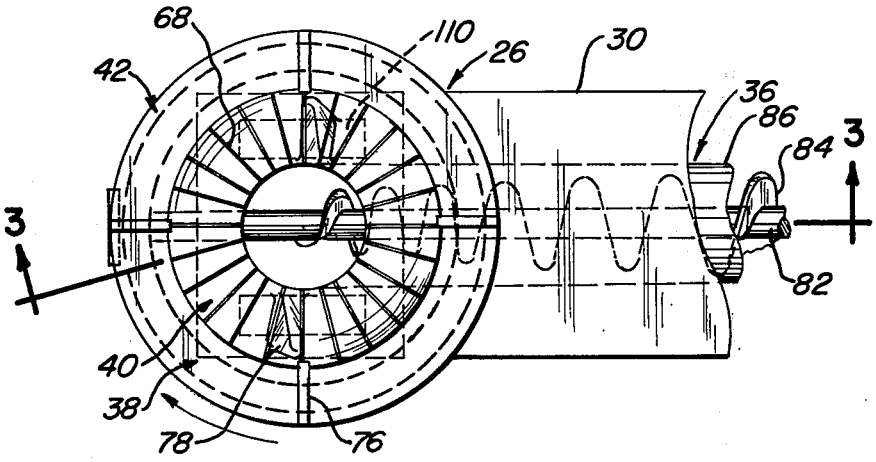
FIG. 2 is a diagrammatic top plan view of the burner and ash ring assembly.

The general plan view of the burning apparatus is diagrammatically illustrated in FIG. 2 in which a feed box 38 supports an annular burner body 40, which in turn supports the annular ash ring 42. The feed box contains fuel and air passages and the burner body is suitably apertured for the flow of combustion air, while the ash ring is mounted for rotation. The details of their construction will be set forth hereinafter. Air supply conduit 30 and fuel conveyor 36 connect to the lower part of the feed box.

Figure 3:
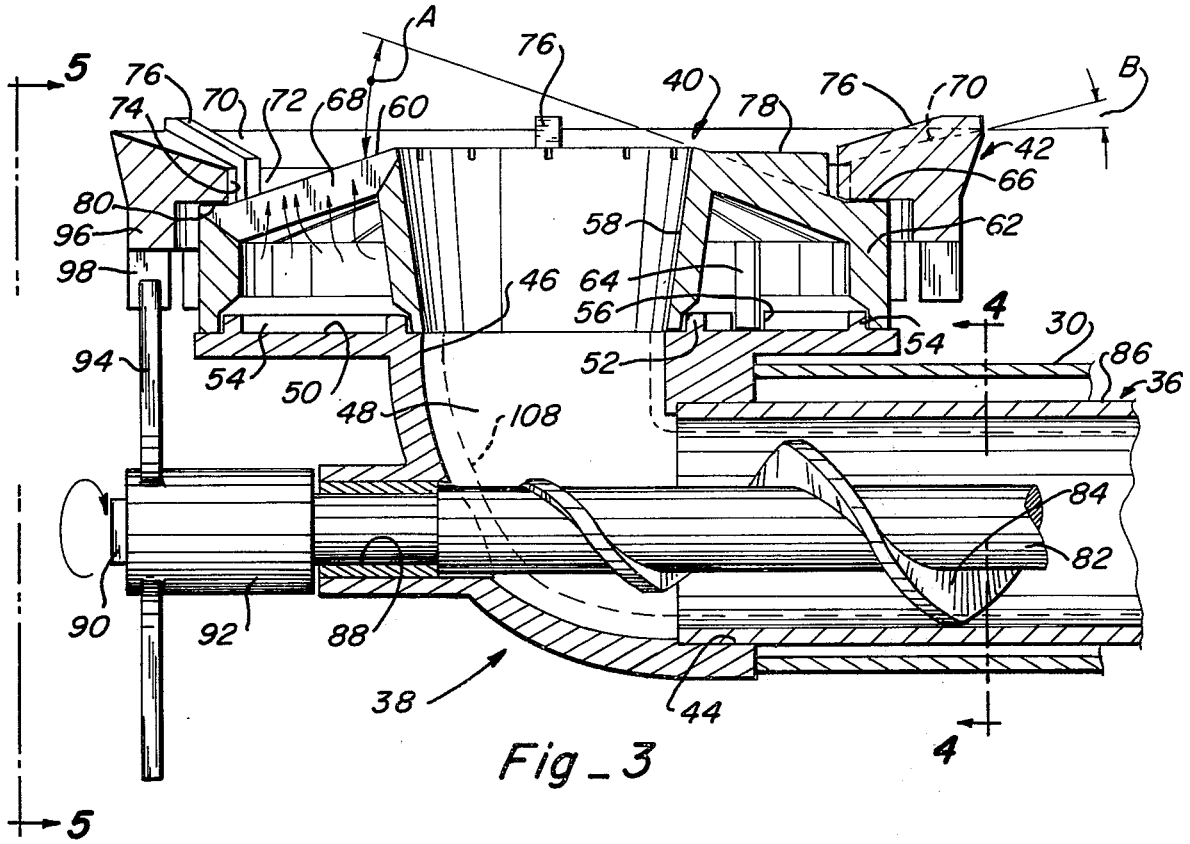
FIG. 3 is a vertical sectional view of the assembly taken on line 3—3 of FIG. 2.
Figure 5:
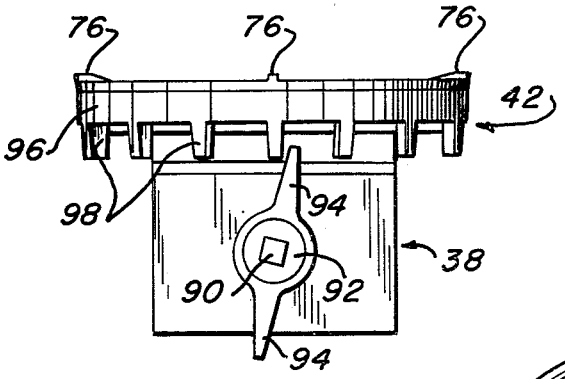
FIG. 5 is an end elevational view of the assembly taken in the direction of line 5—5 on FIG. 3.

The principal components of the apparatus are illustrated in greater detail and on an enlarged scale in FIG. 3. The feed box 38 comprises a hollow body having a generally horizontally directed intake port 44 to which the stoker mechanism or conveyor 36 is connected, a generally vertically directed discharge port 46 for transmission of coal to the burning zone, and an arched or curved fuel passage 48 extending between the ports. The upper end of the feed box is in the form of a horizontal supporting plate 50 surrounding the exit of the discharge port and provided with concentric annular guide ridges 52 and 54, the latter being formed with at least one interruption 56 in its continuity.

Burner body 40 comprises a central annular vertically directed delivery ring 58, an annular burner grid 60 connected to the upper end of the delivery ring and sloping outward and downward at an angle A of the order of twenty degrees, and an annular stabilizing flange 62 depending from the outer perimeter of the burner grid. The bottom margins of the ring and the flange lie in the same plane and are recessed as shown to lie closely adjacent to the inner and outer margins respectively of guide ridges 52 and 54 when they are placed in supported position on plate 50, thus centering ring 58 coaxially with discharge port 46. The lower end of upstanding bracing rib 64 constitutes a detent engaging in recess or interruption 56 and preventing rotation of the burner body with respect to the feed box. It will be apparent that the burner body is supported solely by the feed box by gravity action and restrained against rotation by the detent and recess connection, and no fasteners are required. The outer marginal portion of the grid lies in a horizontal plane and forms a supporting bearing track 66 for the ash ring as explained later. The grid is formed with a plurality of peripherally spaced radially extending apertures 68 through its thickness for upward passage of combustion air.

Ash ring 42 is mounted concentric with the burner body and has an upper surface 70 which slopes outward and upward at an angle B of the order of twenty degrees. The sloping surfaces of the burning grid and the ash ring define between them an annular recess 72 for retaining burning coal so that combustion will be completed before the used fuel passes over the ash ring and is discharged. The inner marginal edge 74 of the ash ring is formed as a substantially vertical wall to intercept and delay the outward movement of the fuel from the grid onto the ash ring. The easy slope of the grid surface assures that the fuel will gradually move out radially as it is burning with the air rising through apertures 68 but at the same time it prevents precipitate dumping of fuel onto the imperforate ash ring before combustion is complete.

The ash ring is driven in clockwise direction, looking down, by mechanism to be described. A plurality of peripherally spaced upstanding ribs 76 are provided on its upper surface and extend between the inner and outer margins and down the inner marginal wall. The ribs may extend at various angles but in the preferred form they are substantially radial. As the ring rotates, the ribs intercept the clinkers which are formed and move radially outward, and tend to break them down while the upward slope of the ash ring surface tends to tumble them back toward the grid for further combustion. At least one breaker tooth 78 is provided on the upper surface of the grid with its radially outer edge adjacent to the path of movement of the ribs and coacts with them in breaking down the clinkers.

The inner marginal portion of the ash ring has a flat planar bottom surface 80 which lies in flat contact with the bearing 66 on the grid for support and rotation. In addition, the direct contact between the members serves as a barrier to prevent ashes and unburned fuel from being discharged between them. The juncture between the sloping surface of the grid and the flat bearing surface 66 defines a detent and guide means for maintaining the ash ring coaxial with the burner body.

The means for causing rotation of the ash ring includes the conveyor shaft 82 carrying the conveyor screw 84 mounted for rotation within tube 86 of the fuel conveyor 36. The shaft is driven by a motor, not shown, and extends into and through the fuel passage 48 in the feed box and out through the side opposite to intake port 44, where it is supported for rotation by bearing 88. On the free end 90 of the shaft is mounted a hub 92 carrying a sprocket 94. The outer margin of the ash ring is formed with a downward flange 96, and a peripherally spaced row of teeth 98 depend from the flange. The sprocket rotates in the path of movement of the teeth and engages them to drive the ash ring.

Figure 7:
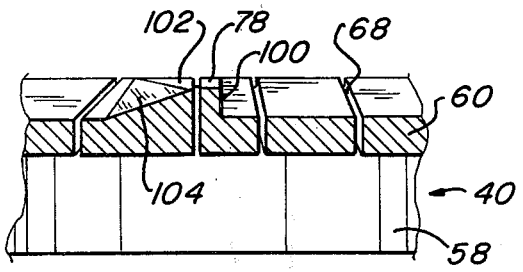
FIG. 7 is a sectional view taken on line 7—7 of FIG. 6.
Figure 6:
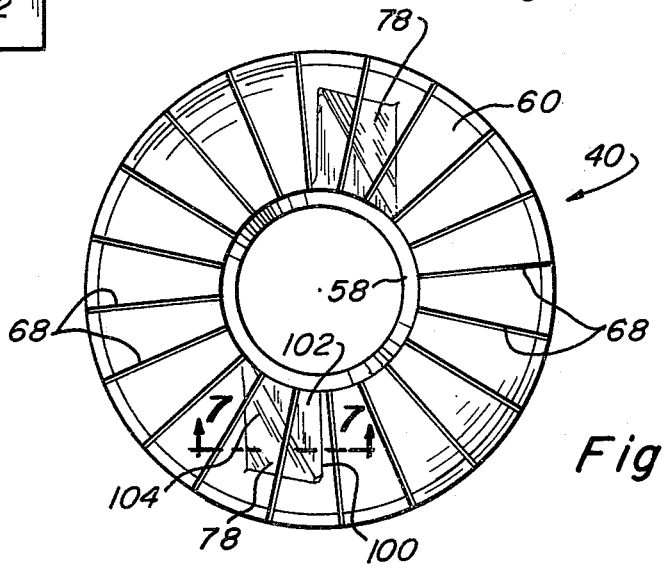
FIG. 6 is a top plan view of the burner body.

The breaker tooth 78 on the burner grid is illustrated in greater detail in FIGS. 6 and 7. It has a substantially vertical leading edge 100 upstanding from the grid surface to confront the oncoming ribs on the ash ring and has a small upper surface 102 which is generally horizontal. The rearward portion 104 slopes downward and rearward to the surface of the grid.

Figure 4:
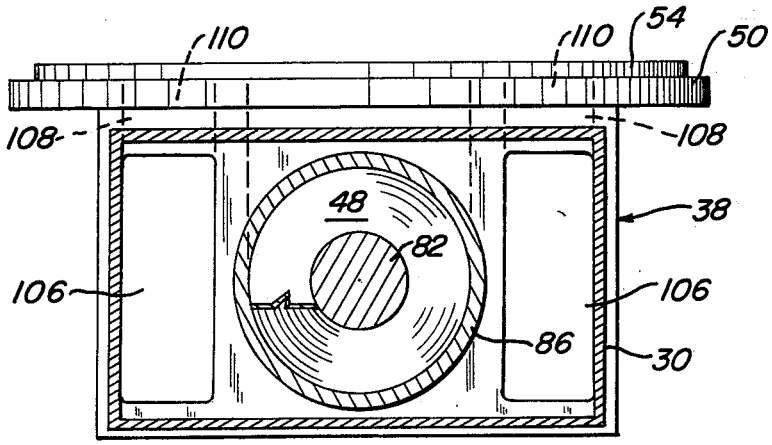
FIG. 4 is a view partly in section, taken on line 4—4 of FIG. 3.

As previously mentioned, air supply conduit 30 surrounds the conveyor tube 86 and is connected to the lower portion of feed box 38. In FIG. 4 it will be seen that the conduit is rectangular in section to encompass both the conveyor tube and two intake ends 106 of a pair of air passages 108, situated at each side of fuel passage 48 within the body of the feed box. The upper ends of the air passages comprise discharge ends 110 terminating in the supporting plate 50 in the area beneath the burner grid 60 and between delivery ring 58 and stabilizing flange 62. The combustion air thus passes into the total annular space within the burner body and out through apertures 68 throughout the burning area.

It will be seen that with the construction described, fuel is distributed evenly and slowly in all radial directions and is retained in the burning area until all of it, including the broken down clinkers, is completely consumed, producing a minimum of pollution and of ash. The number of parts is extremely small and the major components are held in assembled relation without the use of fasteners.

What is claimed is:

1. Stoker actuated coal burning apparatus comprising:

a feed box having a generally horizontal intake port for connection to a fuel-feeding stoker mechanism and a generally vertical discharge port for transmission of coal to a burning zone;

an annular burner body mounted on the feed box and having a central annular vertically directed delivery ring in coaxial communication with the discharge port, and an annular burner grid connected to the upper end of the delivery ring and sloping outward and downward;

and an annular ash ring having an inner marginal portion overlying the outer marginal portion of the burner grid and an outer portion extending outward beyond the grid, with the upper surface sloping outward and upward to define with the grid surface an annular recess for retaining burning coal;

the inner marginal portion of the ash ring resting directly on the outer marginal portion of the grid to prevent discharge of ashes at their juncture, and the outer marginal portion of the grid serving as a bearing for rotational support of the ring;

the burner body being restrained against rotation;

and the ash ring being rotatable about the vertical axis of the burner body.

2. Apparatus as claimed in claim 1; in which the inner marginal edge of the ash ring is formed as a substantially vertical wall to intercept and delay the outward movement of the fuel on the grid.

3. Apparatus as claimed in claim 2; in which a plurality of peripherally spaced upstanding ribs are provided on the upper surface of the ash ring and extend between the inner and outer margins and down the inner marginal wall to intercept clinkers and break them down.

4. Apparatus as claimed in claim 3; in which the ribs extend substantially radially on the upper surface of the ring.

5. Apparatus as claimed in claim 3; in which at least one breaker tooth is provided on the upper surface of the burner grid with its radially outer edge adjacent to the path of movement of the ribs on the ash ring to coact with them in breaking down clinkers.

6. Apparatus as claimed in claim 5; in which the breaker tooth has a substantially vertical leading edge upstanding from the grid surface to confront the oncoming ribs on the ash ring;

the upper surface of the tooth sloping downward and rearward to the surface of the ring.

7. Apparatus as claimed in claim 1; in which the grid is formed with a plurality of peripherally spaced radially extending apertures through its thickness for upward passage of combustion air;

and the ash ring is imperforate to carry all ashes to its outer margin for discharge.

8. Apparatus as claimed in claim 1; in which the outer marginal portion of the grid which serves as a bearing for the ring lies in a horizontal plane;

and its juncture with the sloping portion of the grid defines a guide to maintain the ring in coaxial relation with the grid.

9. Apparatus as claimed in claim 8; in which a fuel supply tube is connected to the intake port of the feed box and a conveyor shaft with a conveyor screw mounted thereon extends into the feed box;

the shaft extends through the feed box to its exterior;

a drive sprocket is mounted on the free end of the shaft;

and the outer marginal portion of the ash ring is provided with a plurality of peripherally spaced depending teeth engageable by the sprocket to cause rotation of the ash ring.

10. Apparatus as claimed in claim 1; in which the slopes of the burner grid and the ash ring surfaces are each of the order of twenty degrees.

11. Stoker actuated coal burning apparatus comprising:

a feed box having a generally horizontal intake port for connection to a fuel-feeding stoker mechanism, a vertical discharge port for transmission of coal to a burning zone, and a curved fuel passage between the ports;

the upper end of the feed box comprising a horizontal supporting plate surrounding the exit of the discharge port;

an annular upstanding guide ridge on the plate having at least one interruption in its continuity;

an annular burner body mounted on the supporting plate and having a central annular vertically directed delivery ring in coaxial communication with the discharge port, an annular burner grid connected to the upper end of the delivery ring, and an annular stabilizing flange depending from the outer perimeter of the burner grid resting on the supporting plate and in substantially positioning contact with the guide ridge;

the stabilizing flange having an abutment engaging in the interruption in the guide ridge to prevent rotation of the burner body with respect to the feed box;

and an annular ash ring having an inner marginal portion overlying the outer marginal portion of the burner grid and an outer portion extending outward beyond the grid;

the ash ring being rotatable about the vertical axis of the burner body.

12. Apparatus as claimed in claim 11; in which the upper surface of the burner grid slopes outward and downward and the upper surface of the ash ring slopes outward and upward to define between them an annular recess for retaining burning coal.

13. Apparatus as claimed in claim 12; in which a plurality of peripherally spaced upstanding ribs are provided on the upper surface of the ash ring and extend between the inner and outer margins and down the inner marginal edge to intercept clinkers and break them down.

14. Apparatus as claimed in claim 13; in which at least one breaker tooth is provided on the upper surface of the burner grid with its radially outer edge adjacent to the path of movement of the ribs on the ash ring to coact with them in breaking down clinkers.

15. Apparatus as claimed in claim 11; in which the inner marginal portion of the ash ring rests directly on the outer marginal portion of the grid to prevent discharge of ashes at their juncture, and the outer marginal portion of the grid lies in a horizontal plane to serve as a bearing for rotational support of the ring;

and its juncture with the sloping portion of the grid defines a guide to maintain the ring in coaxial relation with the grid.

16. Apparatus as claimed in claim 11; in which a fuel supply tube is connected to the intake port of the feed box and a conveyor shaft with a conveyor screw mounted thereon extends into the feed box;

the shaft extends through the feed box to its exterior;

a drive sprocket is mounted on the free end of the shaft;

and the outer marginal portion of the ash ring is provided with a plurality of peripherally spaced depending teeth engageable by the sprocket to cause rotation of the ash ring.

17. Apparatus as claimed in claim 16; in which an air supply conduit surrounds the fuel supply tube and is connected to a source of pressurized air at a first end and connected at the second end to the intake portion of the feed box;

an air passage is formed in the feed box at each side of the fuel passage with an intake end communicating with the air supply conduit and a discharge end terminating in the supporting plate in the area beneath the burner grid and between the delivery ring and the stabilizing flange to supply combustion air to the grid.

* * * * *